US006097281A

United States Patent [19]

Park

[11] Patent Number: 6,097,281

[45] Date of Patent: Aug. 1, 2000

[54] SOUND PRODUCING DEVICE

[75] Inventor: Jin-Kyu Park, Seoul, Rep. of Korea

[73] Assignee: Korean Co., Ltd., Seoul, Rep. of Korea

[21] Appl. No.: 09/309,936

[22] Filed: May 11, 1999

[30] Foreign Application Priority Data

May 11, 1998 [KR] Rep. of Korea ..... 7560/1998
Apr. 17, 1999 [KR] Rep. of Korea ..... 6330/1999

[51] Int. Cl.[7] ..... G08B 3/00

[52] U.S. Cl. ..... 340/384.7; 340/384.1

[58] Field of Search ..... 340/384.1, 384.7, 340/692; 40/124.03, 717

[56] References Cited

U.S. PATENT DOCUMENTS 4,810,997 3/1989 Kudo et al. ..... 340/384 E
5,264,656 11/1993 Itakura et al. ..... 84/600
5,533,290 7/1996 Lee et al. ..... 40/717
5,651,716 7/1997 Mowrer et al. ..... 446/301

*Primary Examiner*—Edward Lefkowitz
*Attorney, Agent, or Firm*—Dann, Dorfman, Herrell and Skillman; Henry H. Skillman

[57] ABSTRACT

A sound producing device separated into a sound producing unit and a power supplying unit. One of two products forming a set is provided with the sound producing unit, the other is provided with the power supplying unit for supplying a power to the sound producing unit so that the sound information can be produced only when the two products are electrically connected each other, whereby the volumes of the products are decreased and their commercial values are increased.

9 Claims, 4 Drawing Sheets

SOUND PRODUCING DEVICE

BACKGROUND OF THE INVENTION

1. Field of the Invention

The present invention relates to a sound producing device, and more particularly, to a sound producing device separated into a sound producing unit and a power supplying unit which are respectively mounted within two products forming a set so that a sound previously recorded in a sound IC of the sound producing unit can be reproduced when the two products are engaged each other.

2. Description of the Related Art

Generally, in a doll or accessories such as a ring and a necklace, a sense of beauty is the very important factor which determines their own value. However, according to a development of a semiconductor device and an increase in customers' preferences for products with which they can produce their own individualities, a functional factor is added to the doll or accessories.

For example, there are a necklace in which a sound IC is mounted and a sound recorded in the sound IC is reproduced when its cover is opened, a ring in which a sound or a light produces when a desired part thereof is pushed, and a doll in which a sound is recorded and the sound is reproduced when a desired part thereof is pushed.

However, in this case, since a sound producing unit including the sound IC and a speaker, and a power supplying unit for supplying a power to the sound producing unit are all provided in each product such as the ring and necklace, the volume of each product is increased, whereby their commercial values are lowered.

SUMMARY OF THE INVENTION

It is therefore an object of the present invention to provide an improved sound producing device separated independently into a sound producing unit and a power supplying unit which are respectively mounted within two products forming a set so that a sound previously recorded in a sound IC of the sound producing unit can be reproduced when the two parts are electrically connected each other, whereby the volumes of the products are decreased and their commercial values are increased.

To achieve the above objects and other advantages, there is provided a sound producing device comprising a first housing which is provided with a first receiving portion and which is made of a conductive material; a sound producing unit which is received in the first receiving portion so that one power receiving terminal thereof is electrically connected with the first housing and which outputs a sound information recorded therein; a first protecting cover for protecting the sound producing unit, which is provided on the first receiving portion and which is electrically connected with the other power receiving terminal of the sound producing unit; a second housing which is provided with a second receiving portion and which is made of a conductive material; a power supplying unit which is received in the second receiving portion so that one power supplying terminal thereof is electrically connected with the second housing and which supplies a power source to the sound producing unit; and a second for protecting the power supplying unit, which is provided on the second receiving portion and which is electrically connected with the other power supplying terminal of the sound producing unit, wherein the first and second housings and the first and second protecting covers are electrically connected each other so as to supply the power source to the sound producing unit, thereby producing the recorded sound information.

For example, the sound producing unit comprises a printed circuit board which is formed with a signal transferring pattern, a positive electrode and negative electrode; a sound IC which is disposed on the printed circuit board and in which the sound information is recorded; a speaker which is electrically connected with the signal transferring pattern-and which reproduces the sound information from the sound IC. The positive electrode of the printed circuit board is connected with the first housing, and the negative electrode of the printed circuit board is connected with the first protecting cover.

The power supplying unit comprises a battery having a positive and a negative electrodes. The positive electrode of the battery is connected with the second housing, and the negative electrode of the battery is connected with the second protecting cover.

Preferably, a spring made of a conductive material is provided between a lower face of the first receiving portion and the positive electrode of the printed circuit board and between a lower face of the second receiving portion and the positive electrode of the battery, respectively.

Preferably, an insulating member is provided between inner side of the first receiving portion and the first protecting cover and between inner side of the second receiving portion and the second protecting cover.

According to the present invention, a sound producing device is separated into two independent parts so as to be respectively mounted in two products forming a set. That is, one of the two products is provided with a sound producing unit including a printed circuit board, a sound IC and a speaker, and the other is provided with a power supplying unit for supplying a power to the sound producing unit.

The sound producing device according to the present invention will embodied through, for example, two rings for a couple and described in detail.

DESCRIPTION OF THE PREFERRED EMBODIMENT

Figure 1:
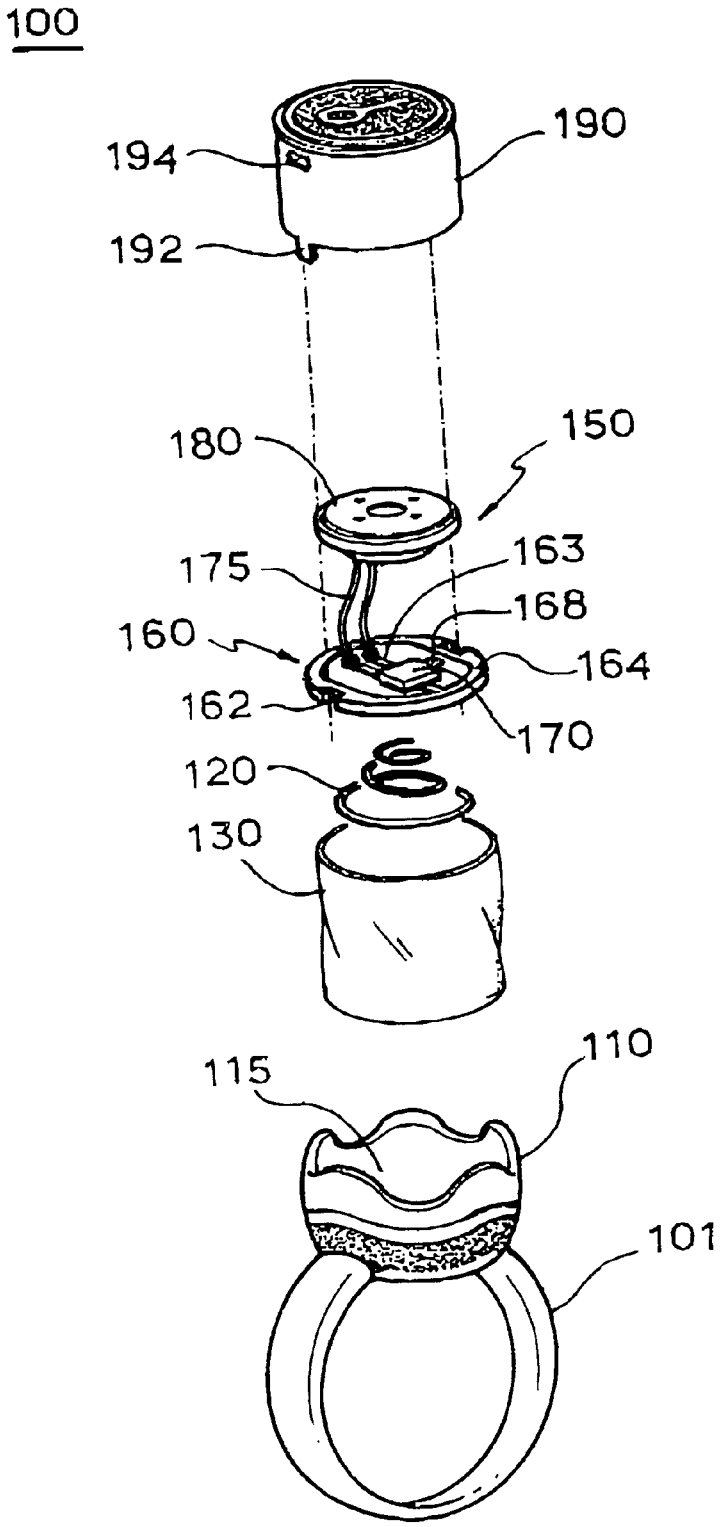
FIG. 1 is an exploded perspective view of a finger ring embodying a sound producing device according to the present invention.
Figure 2:
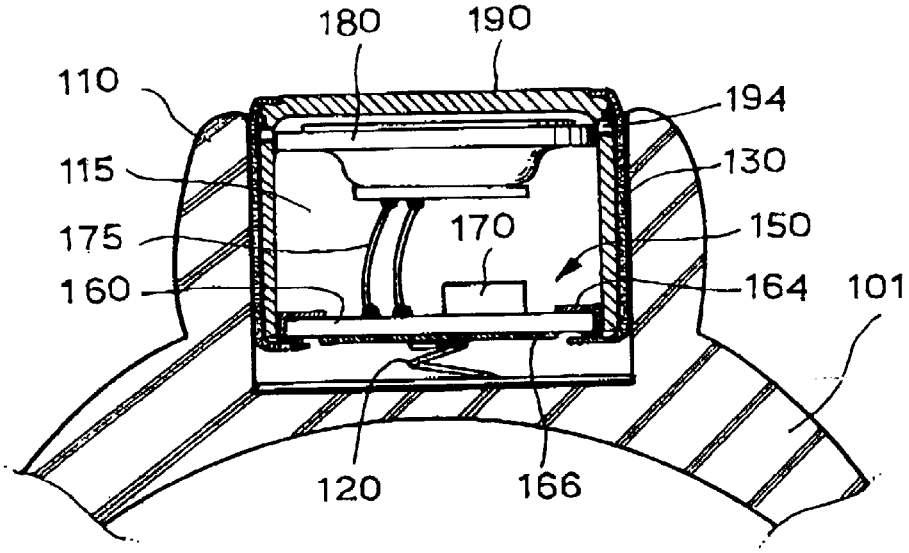
FIG. 2 is a transverse sectional view of the ring of FIG. 1 with the sound producing device assembled.

FIGS. 1 and 2 shows a first ring in which the sound producing unit is mounted.

Figure 3:
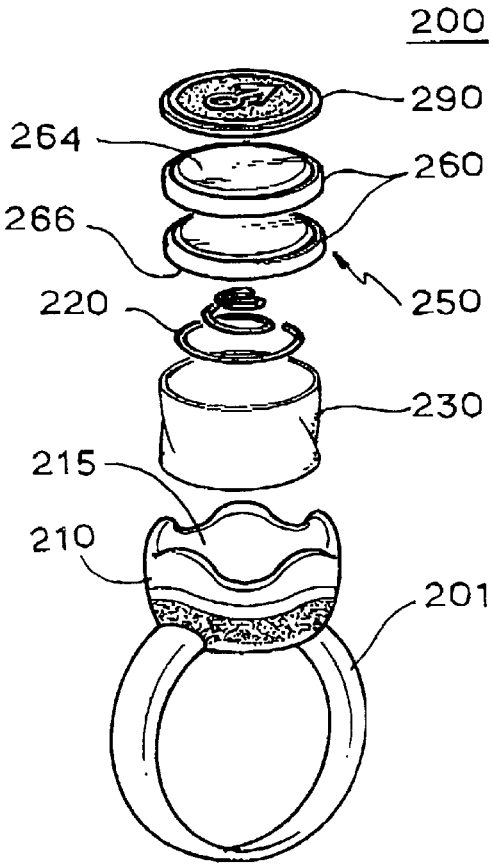
FIG. 3 is an exploded perspective view of a second ring embodying a power supplying unit according to the present invention.

In FIG. 1 and 2, the first ring 100 is formed with a housing 110 which is-projected outward from a circle part 101 so as to be electrically connected with a power supplying unit 250 in FIG. 3 and in which the sound producing unit 150 is mounted. A receiving portion 115 is formed in an upper face of the housing 110 in order to receive the sound producing unit 150 in the housing 110.

In addition, the sound producing unit 150 which is received in the receiving portion 115 and outputs a sound comprises the printed circuit board 160 on which a conductive pattern is printed, the sound IC 70 which is disposed in the printed circuit board 160 and which reproducing the sound previously recorded therein, and the speaker 180 which is connected with the sound IC 170 through a wire 175 and a signal transferring pattern 163 of the printed circuit board 160.

Further, terminal locking slots 162 are formed in opposite sides of the printed circuit board 160. A negative electrode 164 is formed from upper edges of the printed circuit board 160 to the sides of the printed circuit board 160 including the terminal locking slots 162 so as to be connected with the sound IC 170.

A positive electrode 166 is formed in a bottom face of the printed circuit board 160 opposite to a lower face of the receiving portion 115 so as to be connected with the housing 110. The positive electrode 166 is connected through a via hole 168 with the sound IC 170.

Preferably, in order to securely connect the positive electrode 166 with the lower face of the receiving portion 115, an conductive elastic member, for example, a spring 120 is disposed between the printed circuit board 160 and the receiving portion 115.

In addition, in order to be capable of recording a sound information at a user's pleasure, the sound IC which is comprised in the sound producing unit 150 can reproduce a sound which is recorded by the user at his/her option as well as which is previously recorded upon assembling, through the speaker 180.

Meanwhile, a protecting cover 190 is provided on an upper face of the receiving portion 115 so as to protect the sound producing unit 150.

The protecting cover 190 is formed with a connecting terminal 192 at a lower portion thereof corresponding to the locking slots 162 so as to couple up the printed circuit board 160 to the protecting cover 190 as well as to electrically connect the negative electrode 164 with the protecting cover 190.

In addition, in order to transmit the sound to the outside, the protecting cover 190 is formed with a hole 194 at a desired portion thereof.

As described above, since the housing 110 is connected with the positive electrode 166 and the protecting cover 190 is connected with the negative electrode 164, if the sound producing unit 150 is directly inserted into the receiving portion 115, it will be shorted. Therefore, an insulating tape 130 is provided on an outer side of the protecting cover 190.

Next, a structure of a second ring in which the power supplying unit is mounted will be described in detail referring to FIGS. 3 and 4. The second ring 200 in which the power supplying unit 250 is mounted is formed with a housing 210 which is projected outward from a circle part 201 through which a finger is inserted. A receiving portion 215 is formed in an upper face of the housing 210 in order to receive the power supplying unit 250 therein.

The power supplying unit 250 for supplying a power to the sound producing unit 150 comprises two batteries 260 which have a positive electrode 266 and a negative electrode 264, respectively. The positive electrode 266 is connected with the housing 210.

Preferably, an conductive elastic member, for example, a spring 220 is disposed between the positive electrode 266 of the battery 266 and the receiving portion 215 so that the positive electrode 266 is securely connected with the housing 210, whereby the defect of the productions is decreased.

Meanwhile, on an upper face of the receiving portion 215, there is provided a protecting cover 290 which is connected with the negative electrode 264 of the battery 260 and which protects the batteries 260.

As described above, since the housing 210 is connected with the positive electrode 266 of the battery 260 and the protecting cover 290 is connected with the negative electrode 264 of the battery 260, if the housing 210 is directly connected to the protecting cover 290, it will be shorted. Therefore, an insulating tape 230 is provided on an outer side of the power supplying unit 250 so as to insulate the housing 210 from the power supplying unit 250.

The assembling process and operation of the first and second rings will be described more fully referring to FIGS. 5 and 6.

First, in the assembling process of the first ring 100 in which the sound producing unit 150 is mounted, the sound IC 170 is disposed on the printed circuit board 160 so as to be connected with the signal transferring pattern 163, the positive and negative electrodes 164, 166 of the printed circuit board 160. The signal transferring pattern 163 of the printed circuit board 160 is also connected with the speaker 180 through the wire 175.

Then, in order to protect the printed circuit board 160 and speaker 180, the connecting terminal 192 of the protecting cover 190 is aligned with respect to the locking slots 162 of the printed circuit board 160 and is coupled to the locking slots 162 from an upper portion of the speaker 180.

At this time, the connecting terminal 192 is coupled to the locking slots 162 so that the printed circuit board 160 is combined with the protecting cover 190, whereby the negative electrode 164 of the printed circuit board 160 is electrically connected with the protecting cover 190.

After the printed circuit board 160 is combined with the protect cover 190, the insulating tape 130 is provide from the upper edge of the protecting cover 190 to the lower edge portion of the printed circuit board 160 so as to separate the protect cover 190 having negative polarity from the housing 110 having positive polarity.

After that, the conductive elastic member, for example, a spring 120 is disposed on the lower face of the receiving portion 115 so as to electrically connect the positive electrode 166 of the printed circuit board 160 to the housing 110, and the sound producing unit 150 is inserted into the receiving portion 115 so that the positive electrode 166 of the printed circuit board 160 is connected with an upper portion of the spring 120.

Preferably, in order to prevent the sound producing unit 150 from easily getting out of the receiving portion 115 by a vibration and an impact from the outside, the insulating tape 130 provided on the protecting cover 190 is attached to the inner side of the receiving portion 115 by an adhesive.

In this case, the adhesive may be flowed down to the lower face of the receiving portion 115 and insulate the positive electrode 166 of the printed circuit board 160 from the housing 110. However, as shown in FIG. 2, the electrical connection between the positive electrode 166 and the housing 110 is safely secured by a spring 120.

In the assembling process of the second ring 200 in which the power supplying unit 250 is mounted, after the two batteries 260 are overlapped in series, the protecting cover 290 is disposed on the upper face of the negative electrode 264 of the batteries 260.

Then, the two batteries 260 and the protecting cover 290 are fixed each other. The insulating tape 230 is provide from the upper edge of the protecting cover 290 to the bottom edge portion of the positive electrode 266 of the batteries 260 so as to separate the protect cover 290 having negative polarity from the housing 210 having positive polarity.

After that, the power supplying unit 250 is positioned so that the positive electrode 266 of the batteries 260 is opposite to the upper face of the receiving portion 215, while the power supplying unit 250 is inserted into the receiving portion 215.

In order to prevent the power supplying portion 250 from easily getting out of the receiving portion 215 by a vibration and an impact from the outside, the insulating tape 230 provided on the protecting cover 290 is attached to the inner side of the receiving portion 215 by an adhesive.

In this case, the adhesive may be flowed down to the lower face of the receiving portion 215 and insulate the positive electrode 266 of the batteries 260 from the housing 210. However, as shown in FIG. 4, the electrical connection between the positive electrode 266 and the housing 210 is safely secured by a spring 120, whereby the defect of the productions is decreased.

Figure 5:
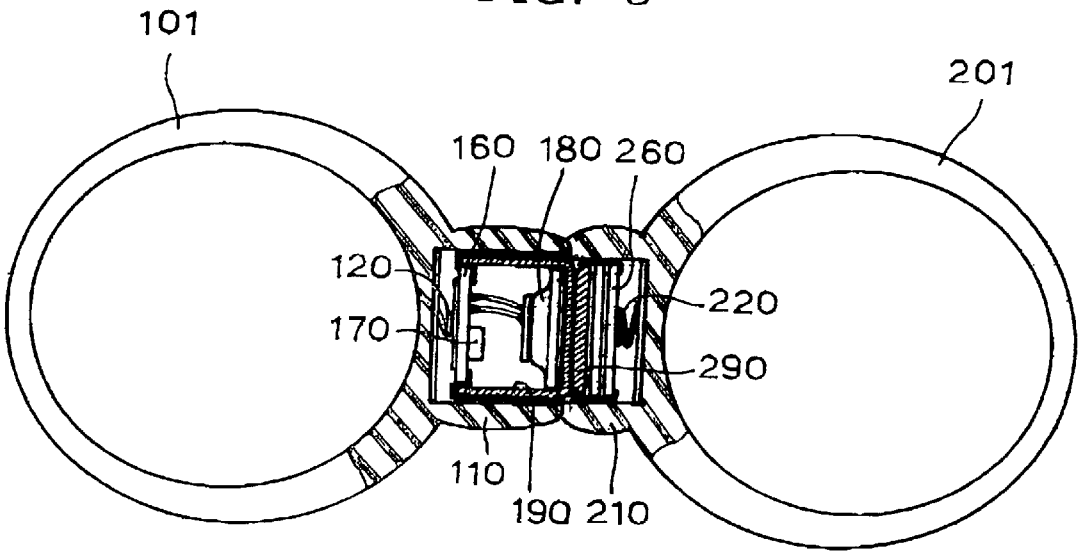
FIG. 5 illustrates the first and second rings when they are coupled into an operating state.

FIG. 5 shows a operating state of the first and second rings 100, 200 assembled as described above. According to the present invention, in order to reproduce the sound recorded in the sound IC 170, the housing 110 and protecting cover 190 of the first ring 100 are engaged with the housing 210 and protecting cover 290 of the second ring 200 each other.

Figure 6:
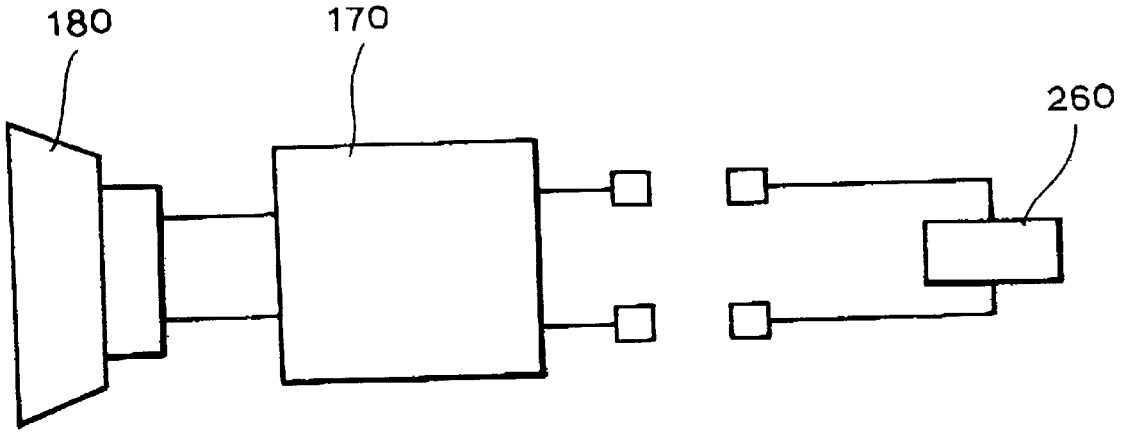
FIG. 6 is a block diagram of the circuits of the two rings.

If the first and second rings 100, 200 are engaged each other according to the invention, a circuit as shown in FIG. 6 is formed so that the batteries 260 of the second ring 200 supplies the power to the sound IC 170. The sound IC 170 detects a sound data recorded in a memory and transmits the data to the speaker 180. The speaker 180 reproduces the sound information corresponding to the sound data and outputs it to the outside.

This operation of the sound producing device according to the present invention is described more fully referring to the FIG. 5.

If the housing 110 and protecting cover 190 of the first ring 100 are engaged with the housing 210 and protecting cover 290 of the second ring 200, the housings 110, 210 and protecting covers 190, 290 of the first and second rings 100, 200, which have the same polarities, respectively, are electrically connected each other, thereby forming the circuit for supplying the power.

Therefore, the power from the batteries 260 is applied to the sound IC through the positive electrode 266 of the batteries 260, the housing 210 of the second ring 200, the housing 110 of the first ring 100, the spring 120 and the positive electrode 166 of the printed circuit board 160.

If the power is applied to the sound IC 170, the sound IC 170 detects the sound data recorded in the memory and transmits the data to the speaker 180. The speaker 180 reproduces the sound corresponding to the sound data from the sound IC 170 and outputs it to the outside.

Meanwhile, the power applied to the sound IC 170 is returned to the negative electrode 264 of the batteries 260 through the negative electrode 164 of the printed circuit board 160, the connecting terminal 192, the protecting cover 190 of the first ring 100 and the protecting cover 290 of the second ring 200.

Described as above, in the sound producing device according to the present invention, one of two products forming a set is provided with a sound producing unit, the other is provided with a power supplying unit for supplying a power to the sound producing unit so that the sound information can be produced only when the two products are electrically connected each other, whereby the volumes of the products are decreased and their commercial values are increased.

In addition, the sound producing device can be applied to a various products such as a necklace, a doll and a cup, etc.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A sound producing device comprising:

a first housing which is provided with a first receiving portion and which is made of a conductive material;

a sound producing unit which is received in the first receiving portion so that one power receiving terminal thereof is electrically connected with the first housing and which outputs a sound information recorded therein;

a first protecting cover for protecting the sound producing unit, which is provided on the first receiving portion and which is electrically connected with the other power receiving terminal of the sound producing unit;

a second housing which is provided with a second receiving portion and which is made of a conductive material;

a power supplying unit which is received in the second receiving portion so that one power supplying terminal thereof is electrically connected with the second housing and which supplies a power source to the sound producing unit; and a second protective cover for protecting the power supplying unit, which is provided on the second receiving portion and which is electrically connected with the other power supplying terminal of the sound producing unit;

wherein the first and second housings and the first and second protecting covers are electrically connected to each other so as to supply the power source to the sound producing unit, thereby producing the recorded sound information.

2. The sound producing unit according to claim 1, wherein the sound producing unit comprises a printed circuit board which is formed with a signal transferring pattern, a positive electrode and negative electrode; a sound IC which is disposed on the printed circuit board and in which the sound information is recorded; a speaker which is electrically connected with the signal transferring pattern and which reproduces the sound information from the sound IC.

3. The sound producing unit according to claim 2, wherein the positive electrode of the printed circuit board is connected with the first housing, and the negative electrode of the printed circuit board is connected with the first protecting cover.

4. The sound producing unit according to claim 3, wherein the printed circuit board is provided with a plurality of terminal locking slots at sides thereof, and the protecting cover is provided with a plurality of connecting terminals at lower sides thereof, the connecting terminals being projected so as to couple the printed circuit board to the first protecting cover and to connect the negative electrode of the printed circuit board with the first protecting cover.

5. The sound producing unit according to claim 1, wherein the power supplying unit comprises a battery having a positive and a negative electrodes.

6. The sound producing unit according to claim 5, wherein the positive electrode of the battery is connected with the second housing, and the negative electrode of the battery is connected with the second protecting cover.

7. The sound producing unit according to claim 2, further comprises a spring made of a conductive material, the spring being provided between a lower face of the first receiving portion and the positive electrode of the printed circuit board and between a lower face of the second receiving portion and the positive electrode of the battery, respectively.

8. The sound producing unit according to claim 5, further comprises a spring made of a conductive material, the spring being provided between a lower face of the first receiving portion and the positive electrode of the printed circuit board and between a lower face of the second receiving portion and the positive electrode of the battery, respectively.

9. The sound producing unit according to claim 1, further comprises an insulating member which is provided between inner side of the first receiving portion and the first protecting cover and between inner side of the second receiving portion and the second protecting cover.

* * * * *

UNITED STATES PATENT AND TRADEMARK OFFICE

CERTIFICATE OF CORRECTION

PATENT NO. : 6,097,281

DATED : August 1, 2000

INVENTOR : Park

Figure 4:
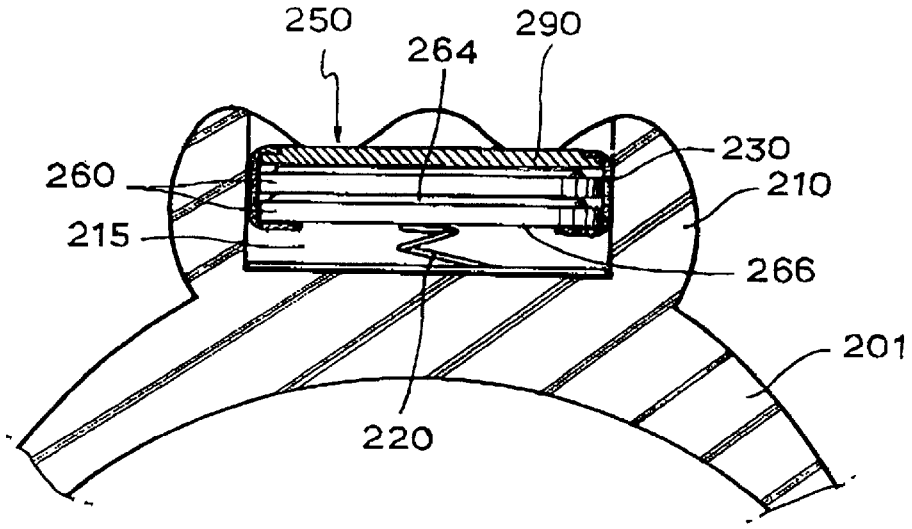
FIG. 4 is an enlarged sectional view showing the power supplying unit assembled in the second ring.

It is certified that errors appear in the above-identified patent and that said Letters Patent is hereby corrected as shown below:

Column 2, the Brief Description of the Drawings should read:

--Fig. 1 is an exploded perspective view showing a structure of a first ring having one part of a sound producing device according to the present invention;

Fig. 2 is a longitudinal sectional view of the first ring in Fig. 1;

Fig. 3 is an exploded perspective view showing a structure of a second ring the other part of the sound producing device according to the present invention;

Fig. 4 is a longitudinal sectional view of the second ring in Fig. 2;

Fig. 5 is a partially sectional view showing the first and second rings which are engaged each other; and Fig. 6 is a schematic circuit diagram showing the sound producing device according to the present invention.--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*